US006300907B1

(12) United States Patent
Lazar et al.

(10) Patent No.: US 6,300,907 B1
(45) Date of Patent: Oct. 9, 2001

(54) ANTENNA ASSEMBLY FOR SUBSURFACE METER PITS

(75) Inventors: Mark Lazar, New Berlin, WI (US); Tienchu Lee, Fremont, CA (US); Noel Marshall, Sebastopol, CA (US); John Glissman, Redwood City, CA (US); Richard Jensen, Helenville, WI (US)

(73) Assignee: Badger Meter, Inc., Milwaukee, WI (US)

( * ) Notice: Subject to any disclaimer, the term of this patent is extended or adjusted under 35 U.S.C. 154(b) by 0 days.

(21) Appl. No.: 09/491,294

(22) Filed: Jan. 25, 2000

(51) Int. Cl.[7] ..... H01Q 1/38; H01Q 1/04

(52) U.S. Cl. ..... 343/700 MS; 343/719; 343/846; 343/850

(58) Field of Search ..... 343/719, 872, 343/850, 860, 846, 848, 700 MS

(56) References Cited

U.S. PATENT DOCUMENTS

| | | | | |
|---|---|---|---|---|
| 4,070,676 | | 1/1978 | Sanford | 343/700 MS |
| 4,401,988 | | 8/1983 | Kaloi | 343/700 MS |
| 4,835,540 | | 5/1989 | Haruyama et al. | 343/700 MS |
| 5,270,704 | | 12/1993 | Quintana et al. | 340/870.02 |
| 5,298,894 | | 3/1994 | Cerny et al. | 343/719 |
| 5,416,475 | | 5/1995 | Tolbert et al. | 340/870.02 |
| 5,519,387 | | 5/1996 | Besier et al. | 340/870.02 |
| 5,583,492 | * | 12/1996 | Nakanishi et al. | 343/719 |
| 5,621,419 | | 4/1997 | Meek et al. | 343/719 |
| 5,703,601 | * | 12/1997 | Nalbandian et al. | 343/846 |
| 5,825,303 | * | 10/1998 | Bloss, Jr. et al. | 343/719 |
| 5,877,703 | | 3/1999 | Bloss, Jr. et al. | 340/870.02 |
| 6,166,692 | | 12/2000 | Nalbandian et al. | 343/700 MS |

* cited by examiner

*Primary Examiner*—Hoanganh Le
*Assistant Examiner*—Hoang Nguyen
(74) *Attorney, Agent, or Firm*—Quarles & Brady LLP

(57) ABSTRACT

An antenna assembly (10) for subsurface utility metering equipment includes a disk-shaped radiating element (50) which is connected through a wire (51) having a self-inductance to a capacitor C and then to a ground plane (41) and a connector (31) for a coaxial cable (30) to provide an LC circuit for impedance matching of the antenna assembly (10) to a transmitter.

12 Claims, 2 Drawing Sheets

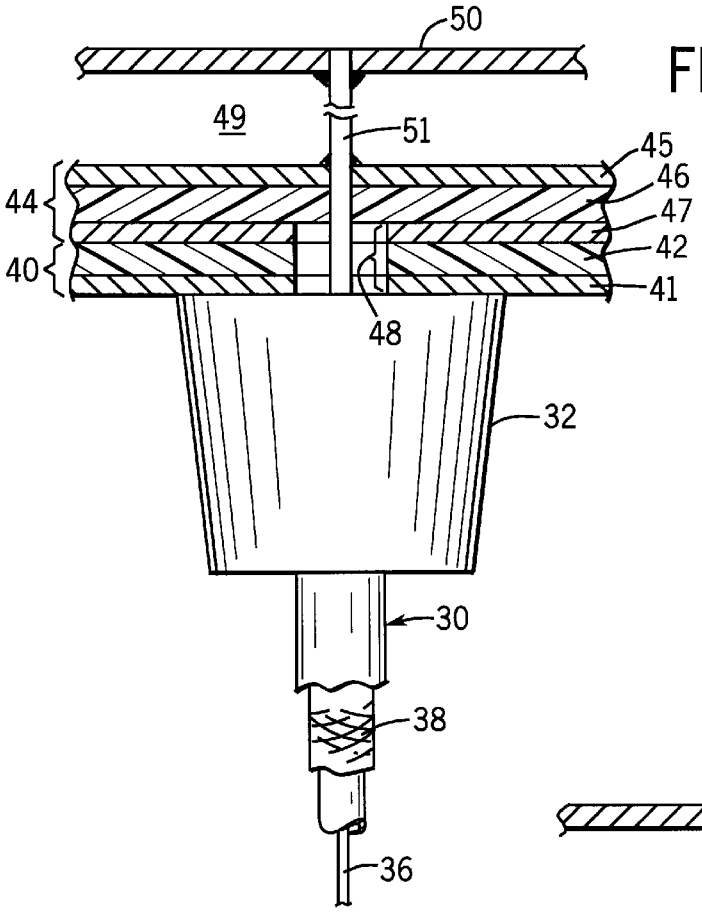
FIG. 3
FIG. 4
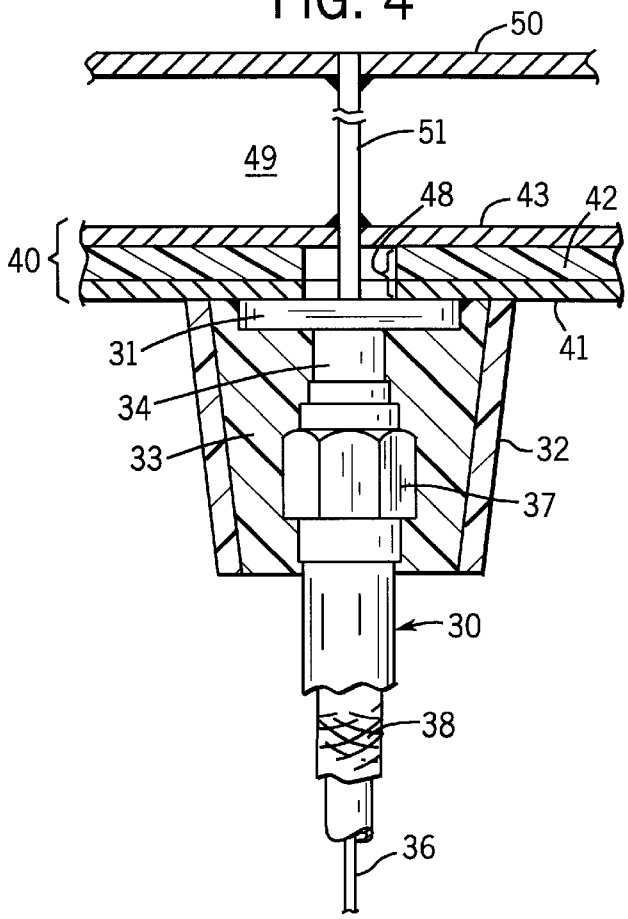
FIG. 5
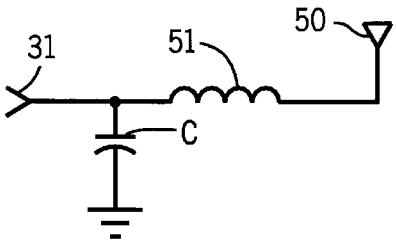

ANTENNA ASSEMBLY FOR SUBSURFACE METER PITS

TECHNICAL FIELD

The invention relates to utility meter transmitter assemblies located in subsurface pit enclosures.

DESCRIPTION OF THE BACKGROUND ART

In moderate climate zones, utility meters are located in subsurface enclosures in areas adjacent to residences or other dwellings. Such enclosures are commonly referred to as "pits." An example of such an enclosure is illustrated in Cerny et al., U.S. Pat. No. 5,298,894.

As further disclosed in Cerny et al., a radio frequency (RF) transmitter may be situated in an assembly which is mounted or otherwise disposed in the pit enclosure. Such a radio frequency transmitter transmits signals representing meter consumption data to a mobile collection unit which may be carried in a vehicle or which may be carried by a person. Radio frequency transmitters may also be used to transmit signals from such a pit enclosure in a network with stationary collection units at predetermined locations. In this type of system, it has become necessary to provide transmitters and antennae with greater power and greater range than in prior art equipment.

Examples of prior art transmitters and antennae are disclosed in Cerny et al., U.S. Pat. No. 5,298,894, and Bloss et al., U.S. Pat. No. 5,877,703. Cerny et al. discloses that the antenna assembly can be separate from, or integrated with, the transmitter assembly.

It is also desirable to make the assemblies which are located in meter pits compact in size, low in cost of manufacture, durable and easy to install and service.

SUMMARY OF THE INVENTION

The invention relates to an antenna assembly for subsurface utility metering equipment. The assembly has a wire which acts as an inductor and which is connected in cascade with a thin, disk-shaped capacitor to provide an LC circuit of controllable impedance.

The antenna assembly more particularly includes a first planar conductor forming a ground plane and having an aperture therein; a dielectric material disposed over said first planar conductor; and a second planar conductor disposed over said dielectric material and having an area which defines a capacitor that includes the second planar member, a portion of dielectric material lying below said second planar conductor and a portion of the ground plane lying below said second planar conductor. A radiating antenna element is disposed in a plane above and generally parallel to the capacitor and separated from the capacitor by a space. The assembly further includes a connector having a ground portion electrically connected to the ground plane conductor, and a substantially rigid wire conductor extending from a signal portion of the electrical connector, through the aperture in the ground plane, for electrical connection to the second planar conductor, and then extending further and through the space to electrically connect to the antenna element.

The substantially rigid conductor is selected to provide an inductance, and the capacitor is selected to provide a capacitance which when cascaded with the inductance provides an impedance for adjustment to an output impedance of the transmitter.

The invention is provided in at least two embodiments having different levels of integration. The capacitive element is advantageously comprised of a circuit board material having two copper or copper alloy conductors and layer of dielectric material in between the two conductors.

In a preferred embodiment of the invention, a diameter of the antenna element is sized such that the antenna operates in the resonant mode. The ground plane, like the antenna element, is also a radial transmission line and has a diameter such that the ground plane operates in an antiresonant mode, in which a voltage minimum occurs at its periphery.

The assembly is enclosed in a housing of plastic insulating material having a cover and a base portion of a construction to be more particularly described below.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

BRIEF DESCRIPTION OF THE DRAWINGS

FIG. 3 is a detail sectional view of an alternative embodiment of the invention taken in the region indicated by line 3—3 in FIG. 2;

FIG. 4 is detail sectional view of a preferred embodiment of the invention taken in same region as FIG. 3; and FIG. 5 is an electrical schematic view of the antenna of the assembly of FIGS. 1–4.

DETAILED DESCRIPTION OF THE PREFERRED AND ALTERNATIVE EMBODIMENTS

Figures 1, 2:
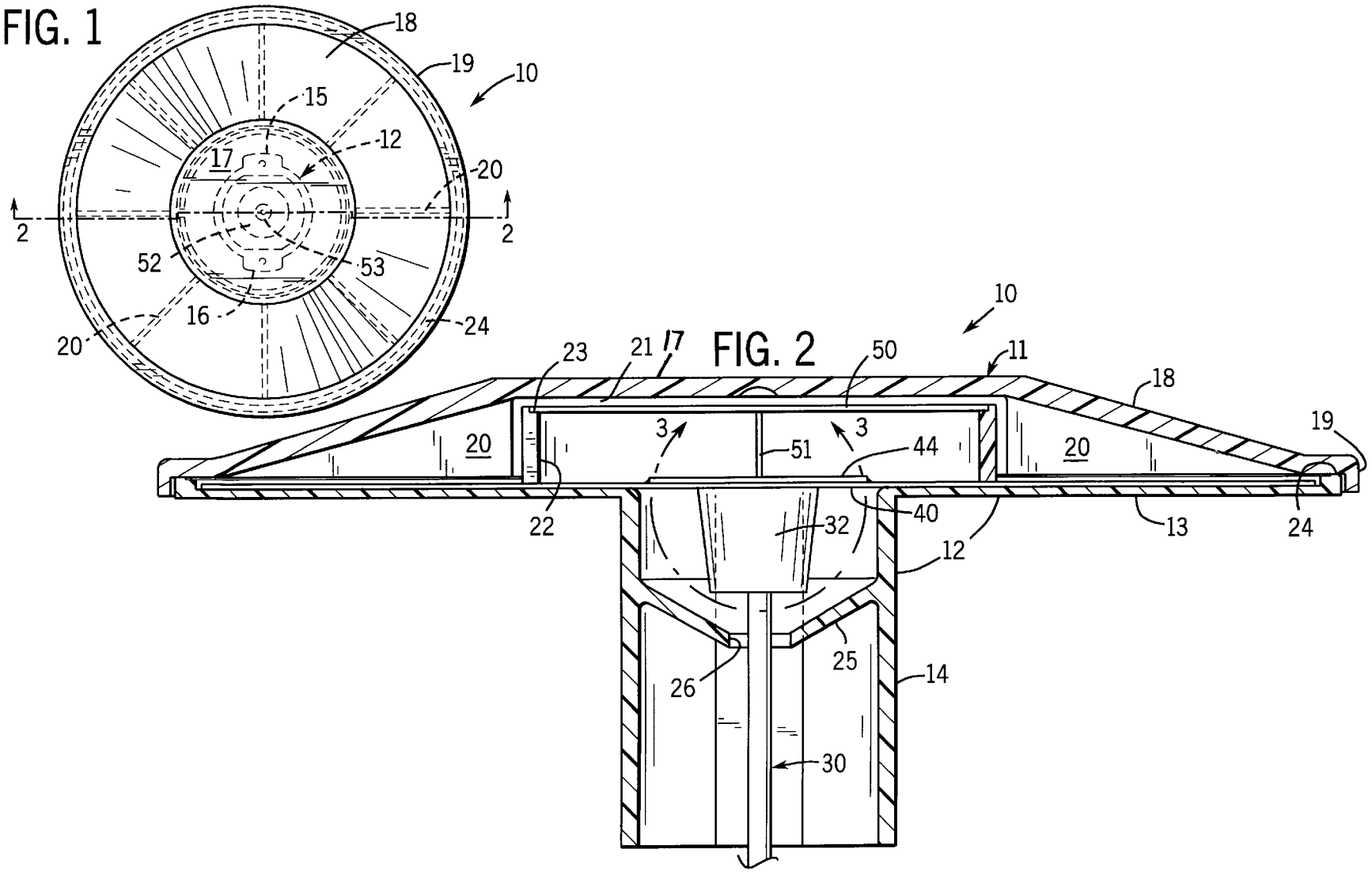
FIG. 1 is top plan view of an antenna assembly of the present invention.
FIG. 2 is a sectional view in elevation taken in the plane indicated by line 2—2 in FIG. 1.

FIGS. 1–2 illustrate parts common to the embodiments of the invention disclosed herein. An antenna assembly 10 of the present invention is provided for RF communication of signals representing utility meter data. The signals are received through a coaxial cable 30 seen in FIG. 2 and radiation from antenna conductor 50, also seen in FIG. 2.

The antenna assembly 10 is enclosed in a housing having a cover portion 11 which is attached to a base 12 which further comprises a disk-shaped cover support portion 13 and a stem portion 14. Elements 11, 12, 13 and 14 are preferably made of a thermoplastic insulating material. The base portion 12 has a cover support portion 13 for supporting the cover 11, and a stem portion 14 of generally circular cross section extending downward therefrom. In use, the antenna assembly 10 has its stem portion 14 inserted in a hole in a pit lid (not shown). The cover 11 and cover support portion 13 would rest on the pit lid (not shown). The generally circular cross section is modified by two projections 15, 16 on opposite sides of the stem with holes at the bottom for receiving a bracket for supporting a transmitter below the antenna assembly.

The cover 11 has a centrally disposed, flat, disk-shaped portion 17. Surrounding the center portion 17 is a beveled portion 18 and at the periphery of the beveled portion is an overhanging rim 19. Underneath the top surface 17, 18, a plurality of radially extending ribs 20 extend from a central cavity 21 to the rim 19. An annular spacer 22 is disposed in the central cavity and has a groove 23 around an upper rim for receiving and forming a support surface for antenna element 50.

The cover support portion 13 has a rim 24 around its periphery on which a portion next to the rim 21 rests. The cover 11 is fastened to the cover support portion 13 at this location by one of several methods including epoxy adhesive, hot plate or ultrasonic welding.

The stem 14 is formed with a funnel-shaped web 25 having a hole 26 through which the coaxial cable 30 extends.

Inside the enclosure, a ground plane is formed as shown in more detail in FIGS. 3 and 4. A disk 40 of FR4 circuit board material, or a similar material, has a planar copper conductor 41 disposed underneath a layer of dielectric, such as a material 42 available from General Electric under the trade designation G-Tek. Other materials which may be used as the dielectric layer include TFE-based (tetrafluoroethylene-based) materials, including Teflon-based materials, and epoxy materials. This material would also have an upper copper conductor (not shown) disposed over the dielectric layer 42, but in the illustrated embodiments, the upper conductor is not present or has been removed, or in the embodiment of FIG. 4, is only partially removed, leaving a disk-shaped conductor 43 of smaller diameter than the ground plane conductor 41.

In FIG. 3, a disk 44 of double-sided FR4 circuit board material, or a similar material, of smaller diameter than the ground plane is disposed over epoxy layer 41. This disk 44 has upper and lower disk-shaped planar conductive members 45, 47 separated by a second portion of dielectric material 46 having, in this example, the same composition as described for material 42. In FIG. 3, the second disk 44 forms a capacitive element. In FIG. 4, the disk-shaped planar conductor 43 forms a capacitive element together with a portion of dielectric material 42 lying below the planar conductor 43, and a portion of the ground plane 41 lying below the planar conductor 43.

A radiating antenna element 50 lies in a plane above and generally parallel to the capacitor and separated from said capacitor by a space 49 provided by spacer 21.

A coaxial cable connector 31 has a ground portion electrically connected to the ground plane 41, the connector having a substantially rigid wire conductor 51 extending through an aperture 48 in the ground plane 41 for electrical connection to the conductor 45 in FIG. 3 and to the conductor 43 in FIG. 4. The wire conductor 51 then extends further through the space 49 to electrically connect to a center of the antenna element 50.

The conductor 51 is selected to provide an inductance, and the capacitor is selected to provide a capacitance which when cascaded with the inductance substantially matches an output impedance of the transmitter for maximum power transfer to the antenna 50. The transmitter (not shown) is connected to the other end of the coaxial cable 30.

The coaxial connector 31 in FIGS. 3 and 4 is a female connector having a threaded sleeve 34 filled with an insulating spacer 52 (FIG. 1) having a hole 53 for receiving the signal conductor 36 of the coaxial cable 30. An SMA-type connector with a0.05-inch center conductor can be used. Soldering connections are indicated in several places: 1) where the connector 31 connects to the ground plane through lower planar conductor 41, 2) where wire conductor 51 connects to capacitor conductor 45 in FIG. 3 and to capacitor conductor 43 in FIG. 4; and 3) where wire conductor 51 connects to antenna element 50. Prior to soldering, the surfaces of the copper alloy conductors are tinned for better electrical connection.

In assembling the unit, the male connector, including a hex-sided collar 37 is threadingly connected to the female connector 31 before assembling the two parts of the antenna housing 11, 12. A tapered sleeve 32 is slipped over the connection and an encapsulating material 33 is filled into a hollow interior of the tapered sleeve 32 and allowed to solidify to seal around the connection.

Referring to FIG. 5, antenna element 50 is represented schematically, along with an inductive element provided by the wire conductor 51, and along with a capacitive element C provided by elements 45, 46, 47, 42, 41 in FIG. 3 and by elements 43, 42, 41 in FIG. 4. The coaxial connector 31 is also represented schematically in FIG. 5, as the first ground, which then connects to signal ground through the coaxial cable ground shield 38. From the schematic in FIG. 5, it can be seen that a circuit is formed with an inductance 51 in series with the radiating antenna element 50 and a capacitance C in parallel with the connector 31 and the coaxial cable. The components can be determined by size and material to provide a matching impedance of fifty ohms to match the output impedance of the transfer and maximize power transfer to the antenna element 50.

The antenna 50 is designed for a transmitter operating frequency in the range of 902–928 Mhz approved by the FCC for this type of equipment. It should be apparent that, as a technical matter, operating frequencies outside this range can be employed including frequencies in the microwave or in UHF range of frequencies.

The diameter of the antenna element is sized such that the antenna operates in the resonant mode. The ground plane, like the antenna element, is also a radial transmission line and has a diameter such that the ground plane operates in an anti-resonant mode, in which a voltage minimum occurs at its periphery.

The driving impedance of the antenna element 50 at resonance is very low typically in the range of about 1 ohm to about 3 ohms. In the LC circuit formed by the antenna assembly, the inductance for impedance matching is provided by the self-inductance of element 51. The capacitance is provided by the capacitance element C described above.

The resulting assembly has very low electrical losses and superior mechanical ruggedness.

This has been a description of the preferred embodiments of the method and apparatus of the present invention. Those of ordinary skill in this art will recognize that modifications might be made while still coming within the spirit and scope of the invention and, therefore, to define the embodiments of the invention, the following claims are made.

We claim:

1. An antenna assembly for RF communication of signals representing utility meter data, the antenna assembly comprising:

A) a capacitive element comprising:

i) a first planar conductor forming a ground plane conductor with an aperture therein;

ii) a dielectric material disposed over said first planar conductor; and iii) a second planar conductor disposed over said dielectric material and having an area which defines the capacitive element, which includes a portion of dielectric material being positioned below said second planar conductor and a portion of the ground plane being positioned below said second planar conductor; and B) an antenna element positioned in a plane above and generally parallel to the capacitive element and separated from said capacitor by a space;

C) a connector having a ground portion electrically connected to the ground plane conductor; and D) an inductive element including a first, substantially rigid portion of a wire conductor that connects the capacitive element to the antenna element, said wire conductor also having a second portion extending through the aperture in the ground plane for electrical connection to the capacitive element; and wherein said capacitive element is selected to provide a capacitance in cascade with the inductance of the inductive element to provide a selected L-C circuit impedance in relation to the antenna element.

2. The antenna assembly of claim 1, wherein the first planar conductor, the dielectric material and the second planar conductor are formed by a piece of circuit board material.

3. The antenna assembly of claim 2, wherein the first planar conductor and second planar conductor are formed of copper or a copper alloy, and wherein the dielectric material is provided in the form of a tetrafluoroethylene-based material.

4. The antenna assembly of claim 2, wherein said circuit board material has a smaller diameter than a diameter of the ground plane.

5. The antenna assembly of claim 1, further comprising a third planar conductor which together with said dielectric material and said second planar conductor are formed by a piece of circuit board material.

6. The antenna assembly of claim 5, wherein the first planar conductor and second planar conductor are formed of copper or a copper alloy, and wherein the dielectric material is provided in the form a tetrafluoroethylene-based material.

7. The antenna assembly of claim 5, wherein said circuit board material has a smaller diameter than a diameter of the ground plane.

8. The antenna assembly of claim 1, further comprising a housing of plastic material enclosing said antenna, said first planar conductor, said second planar conductor, said dielectric and said connector.

9. The antenna assembly of claim 8, wherein said housing comprises a cover portion and a base portion having a cover support portion and a hollow stem.

10. The antenna assembly of claim 9, wherein said stem has lateral extensions for attachment of related equipment.

11. The antenna assembly of claim 9, wherein the cover portion is fastened to said base portion by ultrasonic welding.

12. The antenna assembly of claim 1, wherein the antenna element has a diameter that is sized such that the antenna operates in the resonant mode; and wherein the ground plane has a diameter such that the ground plane operates in an anti-resonant mode.

* * * * *